US007584579B1

(12) United States Patent
Everitt

(10) Patent No.: US 7,584,579 B1
(45) Date of Patent: Sep. 8, 2009

(54) STORM PANEL ATTACHMENT SYSTEM OF PLASTIC COMPOSITION

(76) Inventor: Thomas Joseph Everitt, 4320 Oak St., Little River, SC (US) 29566

( * ) Notice: Subject to any disclaimer, the term of this patent is extended or adjusted under 35 U.S.C. 154(b) by 0 days.

(21) Appl. No.: 11/966,626

(22) Filed: Dec. 28, 2007

Related U.S. Application Data

(60) Provisional application No. 60/882,765, filed on Dec. 29, 2006.

(51) Int. Cl.
*E06B 3/26* (2006.01)
*E06B 3/28* (2006.01)
*E04C 2/38* (2006.01)

(52) U.S. Cl. ..... 52/202; 52/203; 52/656.7; 52/DIG. 12; 160/90; 160/101; 160/106; 160/179; 160/380

(58) Field of Classification Search ..... 52/202, 52/203, 222, 656.7, DIG. 12; 160/90, 101, 160/106, 179, 327, 369, 380, 392, 395
See application file for complete search history.

(56) References Cited

U.S. PATENT DOCUMENTS 2,572,764 A 10/1951 Rogers
2,622,285 A 12/1952 Ross
2,738,040 A 3/1956 Waldin
3,516,470 A 6/1970 Kurz
3,528,196 A 9/1970 Luke
3,745,704 A 7/1973 Covington
4,193,235 A * 3/1980 Cucchiara ..... 52/202
4,333,271 A 6/1982 DePaolo
4,384,436 A 5/1983 Green
4,452,020 A 6/1984 Werner
4,685,261 A 8/1987 Seaquist
5,042,551 A * 8/1991 Ein et al. ..... 160/90
5,228,238 A 7/1993 Fenkell
5,335,452 A 8/1994 Taylor
5,347,775 A 9/1994 Santos
5,477,646 A 12/1995 Dietz et al.
5,487,244 A 1/1996 Hill
5,509,239 A 4/1996 Fullwood
5,596,849 A 1/1997 Hill
5,603,190 A * 2/1997 Sanford ..... 52/202
5,620,037 A 4/1997 Apostolo
5,740,639 A * 4/1998 Covington ..... 52/202
5,768,833 A 6/1998 Golen
5,787,642 A 8/1998 Coyle et al.

(Continued)

*Primary Examiner*—Richard E Chilcot, Jr.
*Assistant Examiner*—Mark R Wendell

(57) ABSTRACT

A storm panel attachment and retaining system designed to accept one or more rectangular storm panels covering an opening in a building as a means of protection from the winds and flying debris associated with severe storm or hurricane forces. The system includes two interchangeable and substantially identical, storm panel attachment and retaining units, fabricated of plastic materials, minimizing the corrosive and rusting affect of coastal salt air environments upon such systems. The attachment units are mounted above and below an opening in a building to be protected, to receive, retain, and support storm panels properly sized to cover the opening. The system configuration accepts a variety of readily available storm panel materials, providing a wide selection during storm related emergency periods. The system is of a design to allow a home owner or do-it-yourselfer to install the attachment units following a severe storm warning, with minimum effort and direction. The system includes security provisions for preserving the installation against unauthorized removal of the panels to discourage looting and vandalism.

8 Claims, 13 Drawing Sheets

U.S. PATENT DOCUMENTS

| | | | | |
|---|---|---|---|---|
| 6,052,957 | A * | 4/2000 | Minnich | 52/202 |
| 6,131,354 | A | 10/2000 | Thompson | |
| 6,269,597 | B1 * | 8/2001 | Haas | 52/203 |
| 6,296,041 | B1 * | 10/2001 | Cicero | 160/327 |
| 6,330,768 | B1 | 12/2001 | Rodrigues | |
| 6,371,422 | B1 | 4/2002 | St. Martin et al. | |
| 6,393,777 | B1 * | 5/2002 | Renfrow | 52/202 |
| 6,851,464 | B2 * | 2/2005 | Hudoba et al. | 160/31 |
| 2004/0206026 | A1 * | 10/2004 | Coogan | 52/222 |
| 2007/0107328 | A1 * | 5/2007 | Munch | 52/202 |
| 2007/0227084 | A1 * | 10/2007 | Skobba | 52/202 |

* cited by examiner

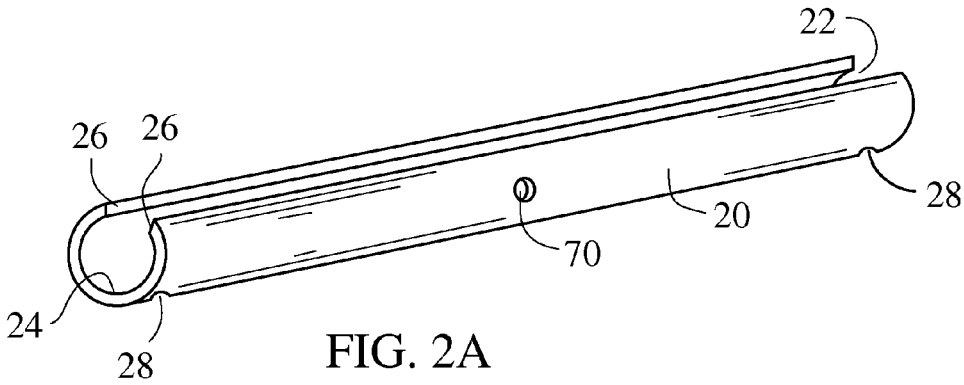
FIG. 2A
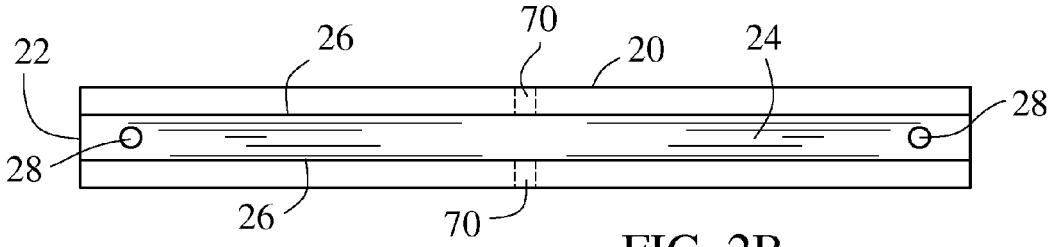
FIG. 2B
FIG. 2C
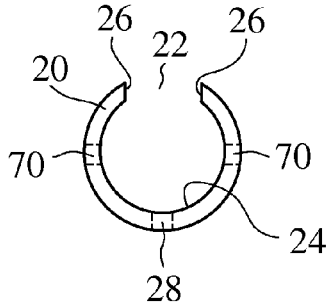
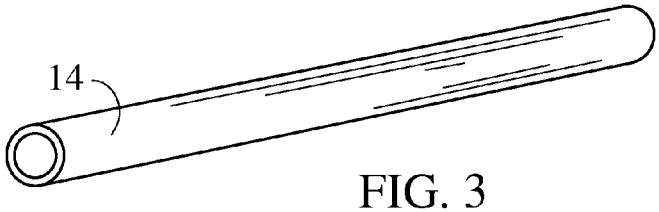
FIG. 3

STORM PANEL ATTACHMENT SYSTEM OF PLASTIC COMPOSITION

CROSS-REFERENCE TO RELATED APPLICATIONS

This application claims the benefit of provisional patent application No. 60/882,765, EFS ID 1407932, Confirmation Number 5550, filed 29, Dec. 2006 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to improved storm panel installation assemblies, specifically devices for home owner installation of such panel materials or boards, during that period following a storm watch or warning, to protect window and other openings in structures from damage caused by wind and wind blown debris associated with severe storms and hurricanes and the related looting and vandalism following a storm.

2. Prior Art

Much of the damage to structures during recent hurricane seasons occurred from wind and wind blown projectiles. Tree branches, outdoor furniture, trashcans, and many other objects were hurled through the air. Broken windows allowed wind and rain access inside homes and businesses. Once the integrity of a structure has been broken, the resultant storm pressure may blow out other windows and lift roofs from the structures. This "Venturi Effect" is a special case of the Bernoulli Principle, or the reduction of pressure producing a partial vacuum. In addition to the storm damage, when evacuation is required, the home and business owners can no longer protect their breached structures from looters and vandals.

The 2005 Atlantic hurricane season began Jun. 1, 2005 and lasted until Nov. 30, 2005. Unexpectedly, this became a most active season, shattering records on repeated occasions, with 27 tropical storms formed, of which a record 15 became hurricanes. The impact of the 2005 season was widespread and ruinous with recorded damages of over $100 billion and a death toll approaching 2,000 lives.

There are a number of sophisticated, commercially available systems for home and business owners to purchase, if they opt to protect their properties far in advance of the hurricane season. These effective systems are often very expensive and require substantial lead time, planning, and time-consuming installation weeks or months ahead of the storm season. A large storm protection industry exists for home and business owners able to afford such complex and expensive systems. Some systems are priced so high per window as to be uneconomical for many homeowners. These systems do not provide immediate solutions to impending damage following a storm watch or warning forecasting a storm's imminent arrival.

Current systems for plywood and plastic panel installation are often accomplished with relatively complex combinations of castings, metal extrusions, molds, machining, custom tooling and the requirement of professional installation for the majority of currently available systems.

Inventors have created several types of apparatus to install storm panels over windows. U.S. Pat. No. 6,330,768 to Rodrigues (2001) discloses a bar assembly that holds the panel against the window with a bar extending from one wall of the window to the other wall. This device is unusable in much of today's construction where windows are flush with the outside surface of the structure, lacking the necessary sills or opposing wall surfaces. The same drawback relates to many patents, including U.S. Pat. No. 6,371,422 to St. Martin (2002).

U.S. Pat. No. 6,269,597 to Haas (2001) discloses a system of 4 permanently mounted channels around the window, properly sized vertically and horizontally for a specific window. The need exists for a temporary system designed to be installed in the hours before a storm arrives, able to accept a wide variety of panels materials of various thicknesses, by a homeowner with average skills, after a storm warning has been issued, U.S. Pat. No. 3,745,704 to Covington (1973) discloses aluminum extrusions shaped to receive and support a single removable plywood panel. The shape is a close tolerance to the thickness of the panel, with minimum provisions for displacement of debris, leaves, and other common airborne contaminants during periods when panels are not in place. Although this approach is effective to a substantial degree, it requires extensive tooling, machining costs and setups. The material specified is subject to salt air corrosion when exposed to coastal environments.

U.S. Pat. Nos. 2,738,040 to Waldin (1956), 3,516,470 to Kurz (1970), 3,528,196 to Luke (1970), 4,333,271 to DePaolo (1982), 4,384,436 to Green (1983), 4,685,261 to Seaquist (1987), 5,228,238 to Fenkell (1983), 5,487,244 to Hill (1996), 5,596,849 to Hill (1997), 5,603,190 to Sanford (1997), 5,620,037 to Apostolo (1997), 5,740,639 to Covington (1998), 5,768,833 to Golen (1998), and 5,787,642 to Coyle (1998) show various types of storm shutter attachment techniques requiring professional installation or special panels. These systems cannot be considered quick and low cost apparatus for installing a variety of whatever storm panel materials are available, often with only hours to spare before a violent storm comes ashore. In the hours before a hurricane, available materials of choice would include plywood, corrugated plastic, or common lumber.

U.S. Pat. No. 6,131,354 to Thompson (2000), discloses a complex system of locking mechanisms, brackets and mounts that are permanently attached to a structure. The bracketed system is not simple in nature and not suitable for installation during the hours prior to a storm making landfall.

Other disclosures of interest are found in U.S. Pat. Nos. 2,572,764 to Rogers (1951, 2,622,285 to Ross (1952), 4,452,020 to Werner (1984), 5,335,452 to Taylor (1994), 5,347,775 to Santos (1994), 5,477,646 to Dietz (1995), 5,509,239 to Fullwood (1996), 6,393,777 to Renifrow (2002), and 6,9355,082 to Friedman (2005).

The following U.S. Patents are incorporated herein by reference: U.S. Pat. Nos. 2,794,217 to Croft (1957), 3,968,607 to Baran (1976), 4,085,788 to Bernardo (1978), 4,590,706 to Plowman (1986), 4,671,012 to Merklinger, et al. (1987), 5,383,509 to Gaffney, et al. (1995), 5,507,118 to Brown (1996), 5,673,883 to Figueroa, Jr. (1997), 5,709,054 to McGillivray (1998), 5,833,081 to Smith (1998), 5,937,593 to White (1999), 5,943,832 to Russell (1999), 7,069,700 to Heissenberg (2006), and 7,104,015 to Huynh (2006).

Following tropical storm warnings, little time remains for home and business owners to attempt to protect window and door openings from the damage associated with severe storm winds. The most common method to attempt protection, following the warning, is to nail plywood, boards, plastic panels, or other available materials over windows and doors as a form of emergency protection. Nailing or bolting plywood over openings can create many problems. Driving nails into window frames and masonry structures causes unsightly damage to the surface. Following the storm, other problems often result from removing the panels, sometimes inducing rotting, discoloration, and other forms of damage.

Following a storm watch or warning, the demand for plywood and other types of panels is heavy at building material suppliers and big box lumber yards. The missing component during this rush for protection, is a fast and simple way to mount temporary storm panels with minimum damage to the structure. Sheets of plywood and other materials are heavy, unwieldy, and essentially impossible for one person to support and hold a sheet in place while trying to nail it to the structure, especially if the weather is deteriorating.

Prior art does not provide the missing component in this protection scenario for a simple and low cost apparatus designed specifically for home and business owners to attach and retain plywood, plastic panels, or boards to structures immediately prior to or soon after a storm warning, using available do-it-yourself home owner tools.

The panel attachment systems, heretofore known, suffer from one or more of the following disadvantages:

(a) Their fabrication requires a manufacturer capable of complex mechanical sub-assemblies, extrusions, foundry or casting capabilities, and adherence to precise tolerances.

(b) Tooling and set up costs prior to manufacturing are normally substantial.

(c) A majority of prior art devices are fabricated of metal. Coastal climates are known for corrosive salt air that will eventually cause aluminum to corrode, steel to rust, and plating to deteriorate. Stainless steel is an obvious but prohibitively expensive alternative to aluminum and other metals.

(d) Systems requiring indented window openings with sills or side walls are of no use with windows mounted flush with the outside surface of the structure.

(e) Current flexible screen systems do not claim protection against glass breakage and require permanent unattractive multiple screw sockets around the entire window frame.

(f) Some prior art examples with close tolerances may be rendered less than optimum due to the requirement for regular maintenance or refinishing in corrosive salt air coastal environments.

(g) "U" shaped channels and tracks with close tolerances are subject to the drawbacks of debris accumulation, rendering them less than optimum.

(h) Lack of provisions for securing, locking or otherwise deterring the removal of storm panels is not addressed in many prior designs.

Prior art does not address the missing component of a simple, non-corrosive, and relatively low cost method of attaching plywood or plastic storm panels for protection against the destruction of property, looting, and vandalism associated with severe tropical storms during the limited time available following a storm watch or warning.

BACKGROUND OF INVENTION

Advantages

Accordingly, one or more embodiments of the present invention may have one or more of the following advantages:

(a) to provide an affordable and improved solution for the rapid installation of emergency storm panels by the average home or business owner prior to or following a storm watch or warning;

(b) to provide a panel attachment system designed to reduce manufacturing requirements and costs for set-up, tooling, and jigs;

(c) to provide an effective storm panel attachment system fabricated from materials selected for their non-rusting and non-corrosive properties to reduce the corrosive affect of salt air coastal environments;

(d) to design a system fabricated from relatively low-cost materials in plentiful supply to enhance affordability;

(e) to provide an off-the-shelf panel attachment system designed to reduce installation requirements and eliminate extended delivery and custom fabrication lead times or costly custom designing;

(f) to provide a panel installation system without a requirement for indented walls or inside sills around window openings;

(g) to provide a system with a provision allowing an owner the option of securing or locking installed storm panels in order to discourage unauthorized removal of panels and storm related looting and vandalism;

(h) to provide a panel installation system designed to reduce tooling and manufacturing set-up costs when fabricating a variety of lengths and sizes;

(i) to provide a system of compatible components allowing side by side installation for protecting long expanses of windows.

(j) to provide a system which reduces the need to discard storm panels damaged by nailing and bolting them directly to the outside building surface.

Further advantages of my interchangeable design of the assemblies allows panel installation from the right or left side of the opening.

Therefore, there is a need in the marketplace for an affordable and relatively simple storm panel installation system, installed by the owner following a storm watch or warning, effective in protecting windows and doors from wind and flying debris during a severe storm.

The improved panel installation system herein invented can, in one configuration, fill the above need using an unobvious application of corrosion-resistant, off-the-shelf Polyvinyl Chloride (PVC) pipe.

Further advantages of my invention will become apparent from a consideration of the drawings and ensuing description.

SUMMARY

The present invention is directed towards an improved system for securing storm panels to a building structure. The system is comprised of two interchangeable, substantially identical, storm panel attachment and retainer units, fabricated of corrosive-resistant, non-rusting plastic materials. The design improves upon prior art by virtue of the non-rusting materials incorporated and the ability of a home or business owner, possessing average do-it-yourself skills, to install the system following a storm warning, using a variety of those adaptable materials available during the period following a storm watch or warning. The devices are mounted parallel above and below the opening in the building to be protected, to receive the selected storm panel materials.

DRAWING FIGURES

In the drawings, closely related figures have the same number but different alphabetic suffixes.

FIGS. 2A, 2B, and 2C show various aspects of a panel track element prior to fabrication.

FIG. 3 is an attachment element prior to fabrication.

Figure 1A:
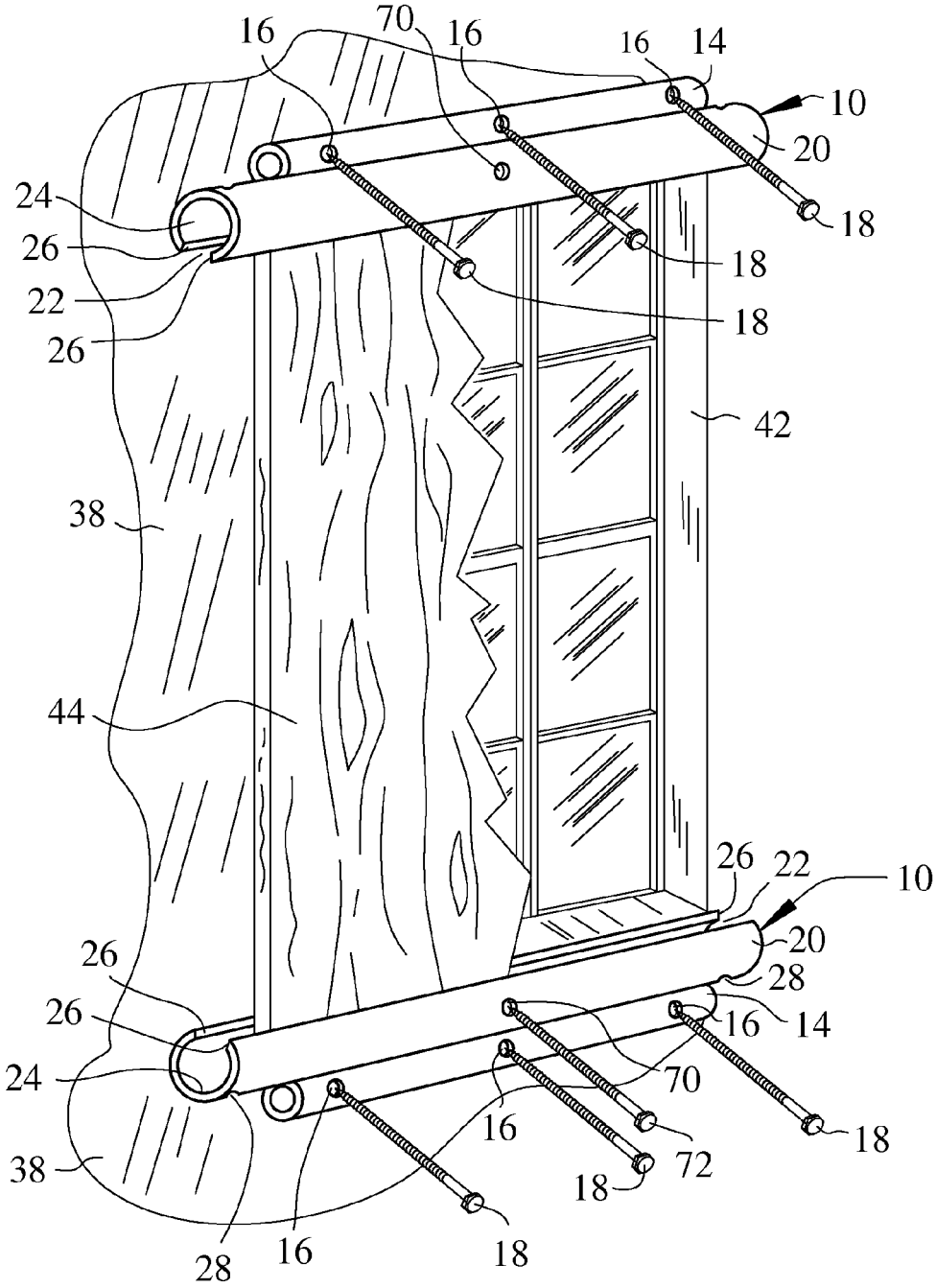
FIG. 1A is a perspective view of panel attachment units mounted above and below a window opening in accordance with one embodiment.
Figure 4A:
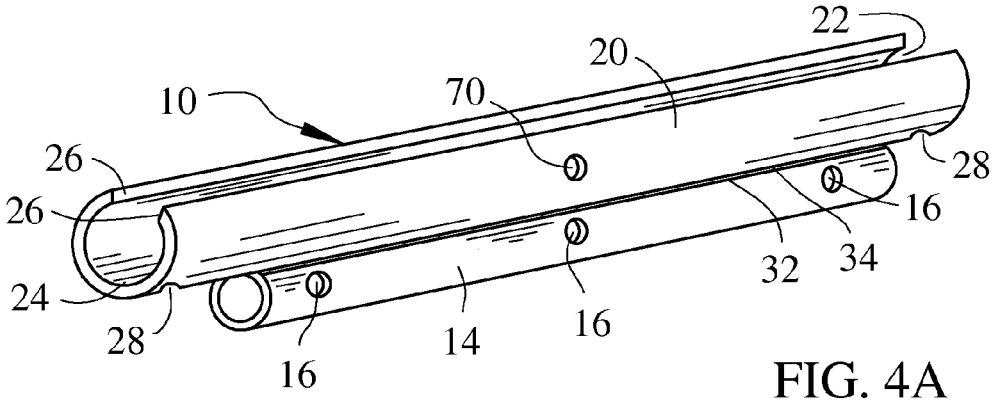
Figure 4B:
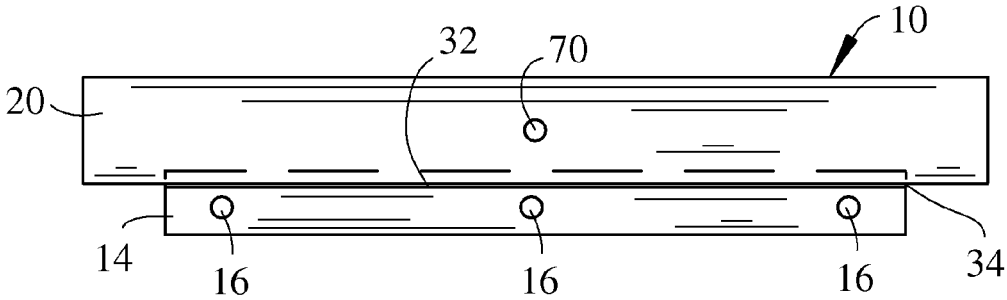
Figure 4C:
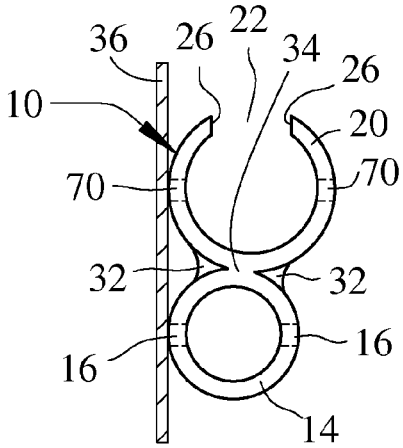

FIGS. 4A, 4B, and 4C show various aspects of a panel attachment unit of FIG. 1A.

FIGS. 5A, 5B, 5C, and 5D show various aspects of the embodiment of FIG. 1A related to security devices.

Figure 1B:
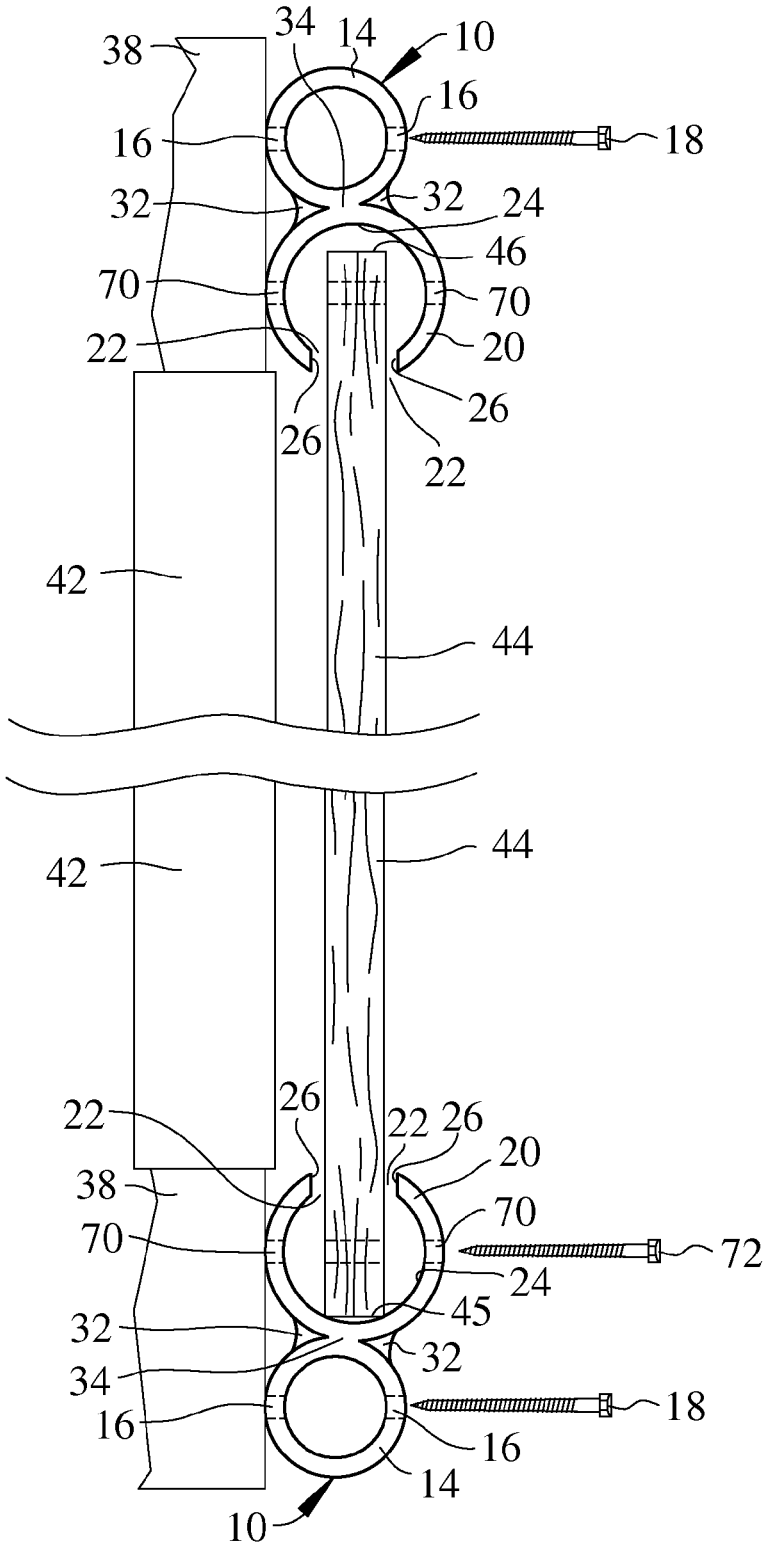
FIG. 1B is an end view of the mounted attachment units of FIG. 1A.
Figure 6:
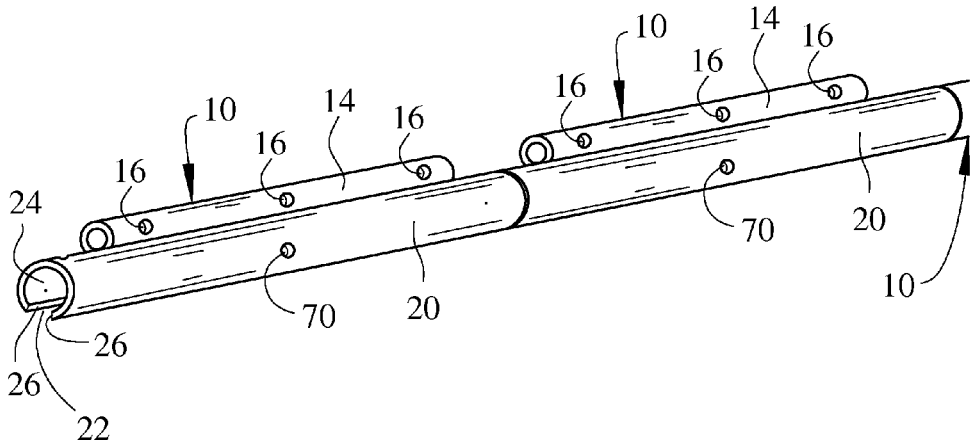
Figure 6:
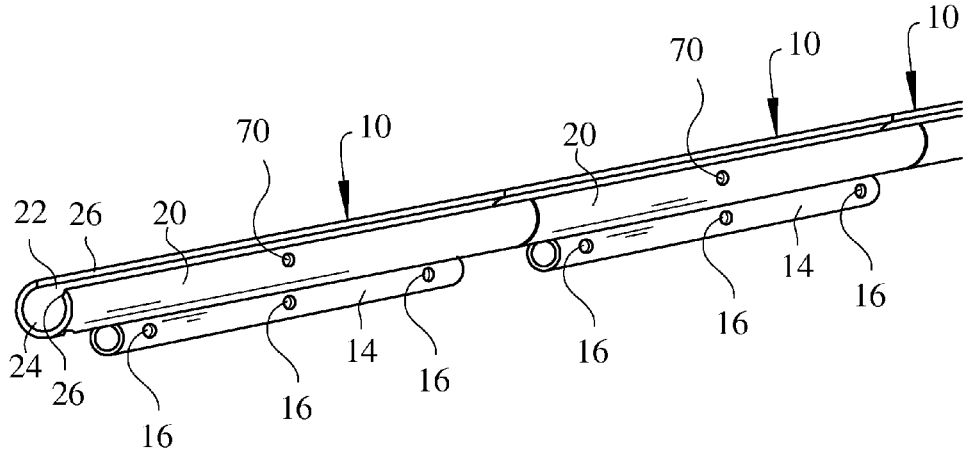

FIG. 6 is a perspective view of the embodiment of FIGS. 1A and 1B mounted in a contiguous end-to-end relationship.

Figure 7:
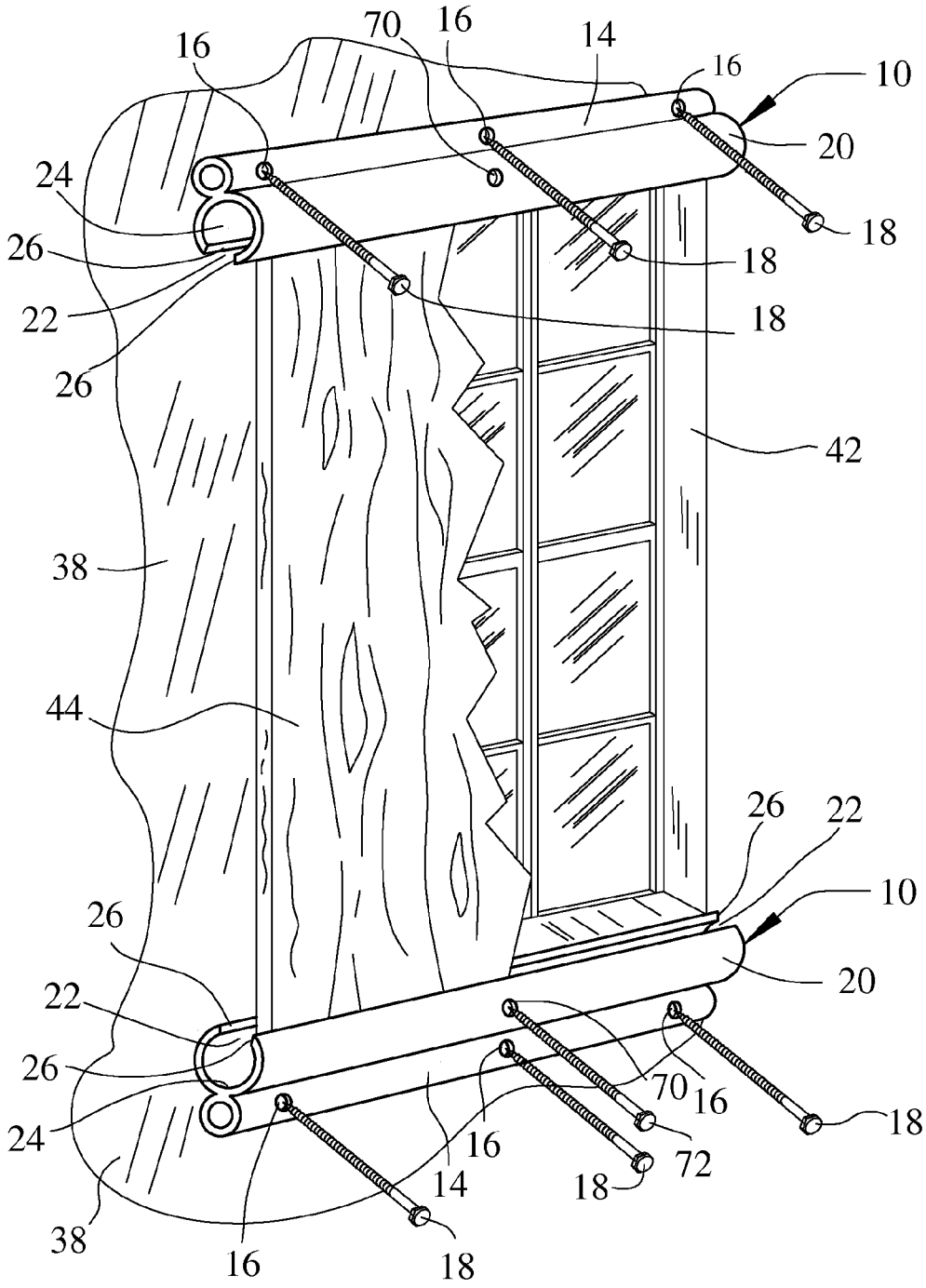

FIG. 7 is a perspective view of an embodiment of the attachment units with flush ends.

Figure 8A:
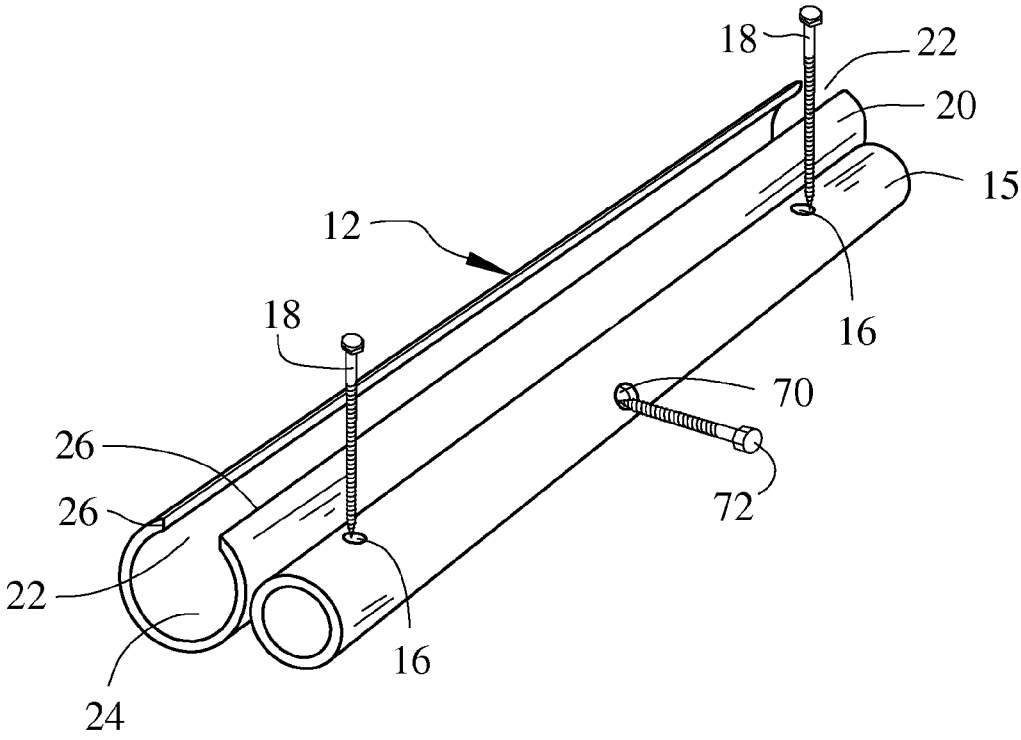

FIG. 8A is an alternative embodiment of a panel attachment unit with provisions for mounting to a horizontal surface.

Figure 8B:
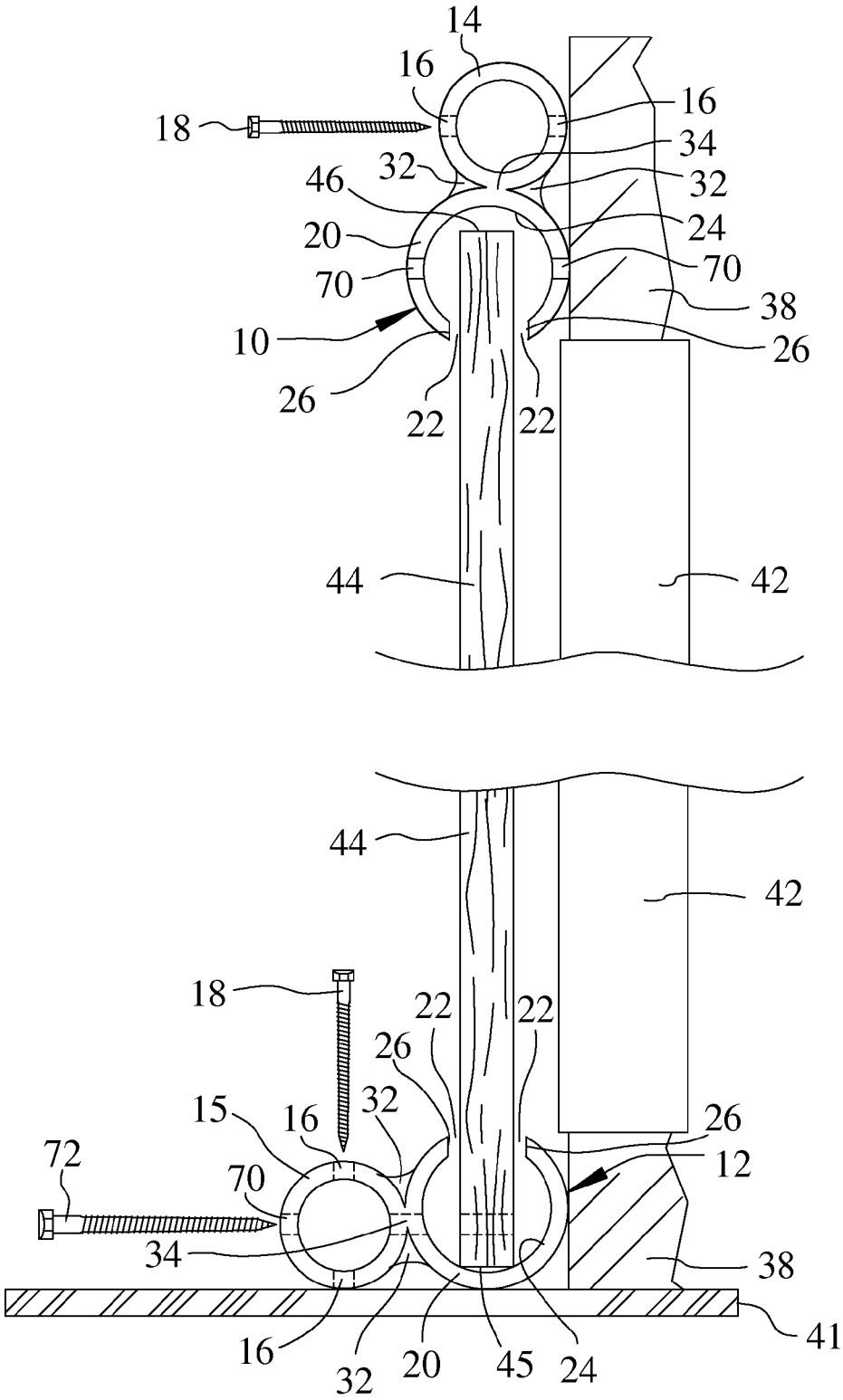

FIG. 8B is an end view of the embodiment of FIG. 8A secured to a horizontal surface and the embodiment of FIGS. 1A and 1B secured to a vertical surface.

Figure 9A:
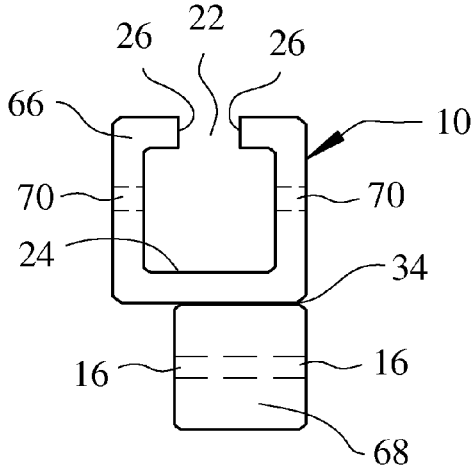
Figure 9B:
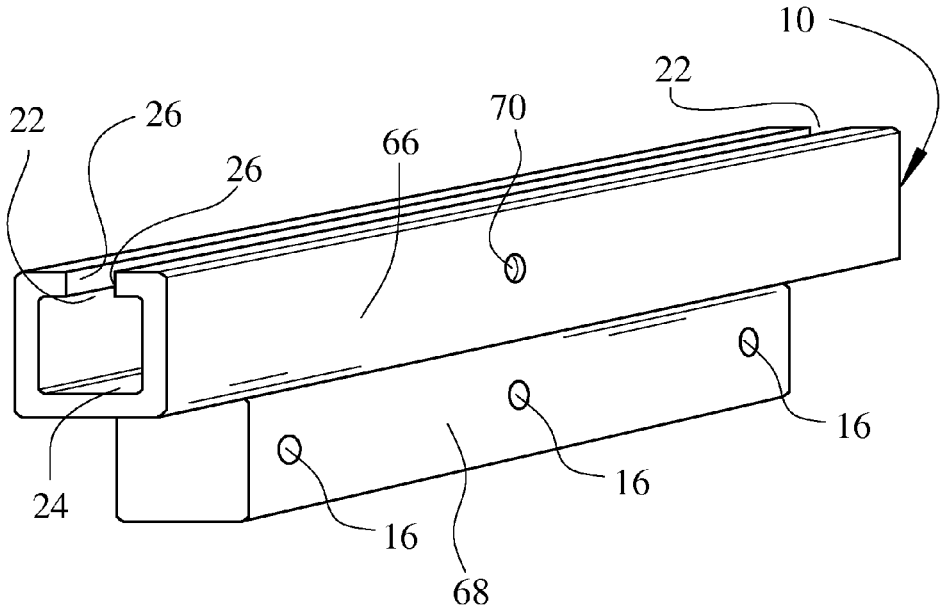

FIGS. 9A and 9B show various aspects of an alternative embodiment of elements formed from rectangular plastic tubing and solid rod.

Figure 9C:
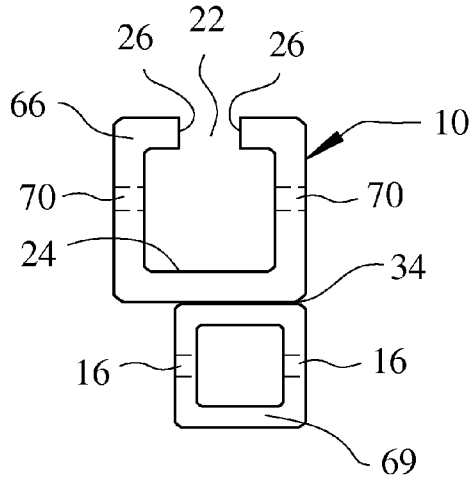
Figure 9D:
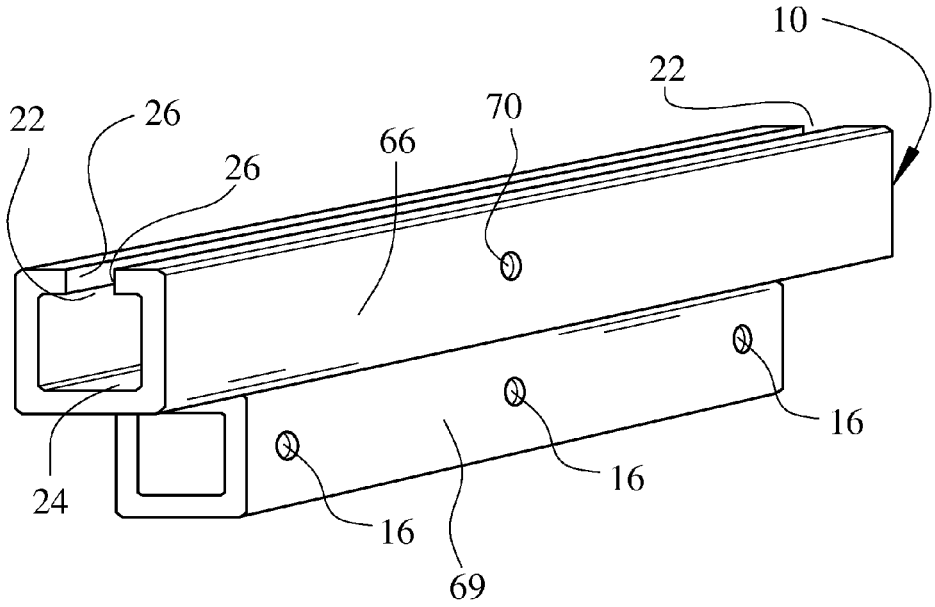

FIGS. 9C and 9D show various aspects of an alternative embodiment of elements formed from hollow rectangular plastic tubing.

Figure 10A:
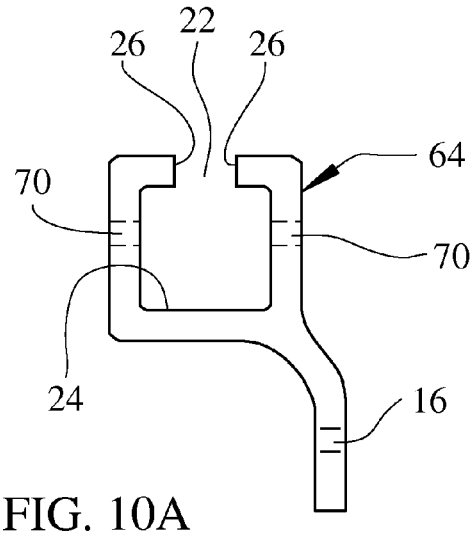

FIG. 10A is an end view of a plastic extrusion of a panel attachment unit in accordance with another embodiment.

Figure 10B:
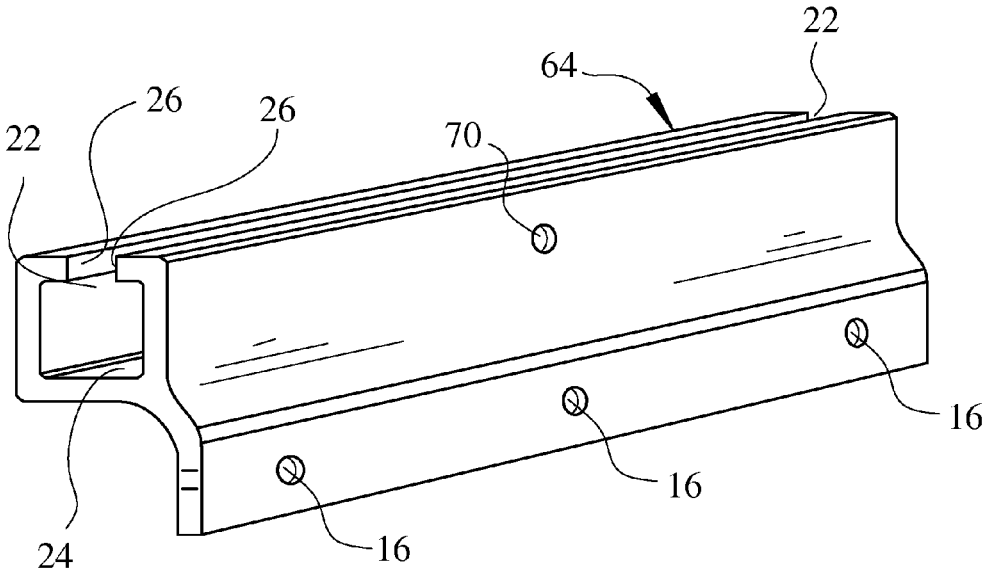

FIG. 10B is a perspective view of the extruded attachment unit shown in FIG. 10A.

Figure 11:
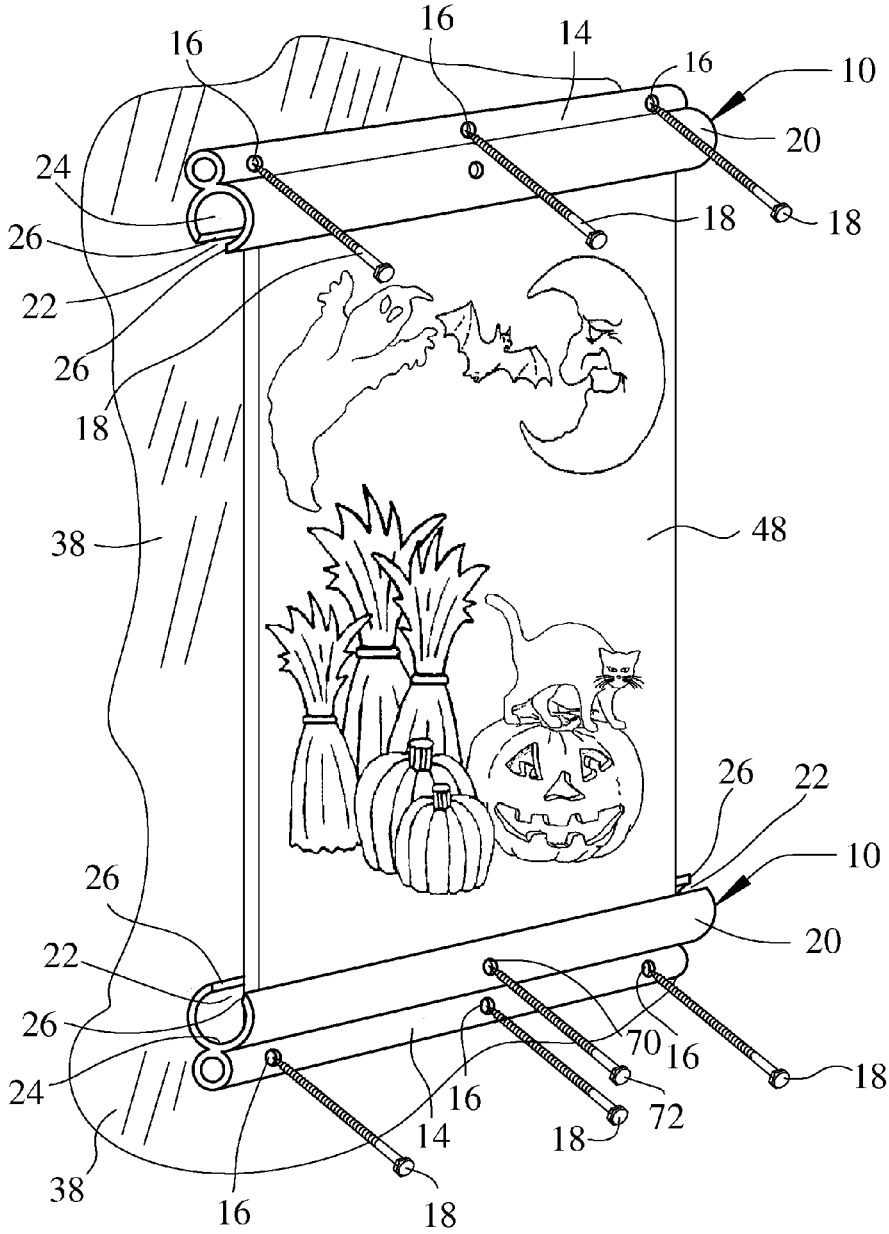

FIG. 11 shows the embodiment of FIG. 7 as attachment units for decorative holiday panels.

REFERENCE NUMERALS

10. panel attachment unit
12. floor panel attachment unit
14. attachment element
15. deck attachment element
16. attachment element apertures
18. fastener
20. panel track element
22. panel channel track
24. inside surface of track element
26. retaining face
28. security device aperture
32. adhesive caulk
34. bonded area
36. vertical reference plane
38. vertical building structure
41. horizontal structure
42. window opening
44. storm panel
45. bottom edge of storm panel
46. top edge of storm panel
48. decorator window panel
50. security sleeve
52. security sleeve aperture
54. security sleeve opening
55. security sleeve face
56. padlock security device
58. cap screw
60. cap screw locknut
64. extruded panel attachment unit
66. rectangular plastic track element
68. rectangular rod attachment element
69. hollow rectangular attachment element
70. security fastener aperture
72. security fastener

DETAILED DESCRIPTION OF THE FIRST EMBODIMENT

Referring now to the drawings, one form of the storm panel attachment system embodying the principles and concepts of the present invention will be described. One embodiment of the storm panel attachment system is illustrated in FIG. 1A (perspective view) and FIG. 1B (end view). As can be seen by reference to the drawings, and in particular to FIGS. 1A and 1B, the interchangeable storm panel attachment and retaining units that form the basis of the present invention are designated generally by the reference number 10 and are attached to the outer wall of a building structure thereof indicated as 38, above and below a window opening 42. Referring first to FIG. 1A, a building structure 38 has a rectangular window opening 42, two storm panel attachment units 10, and a user fabricated storm panel 44. As illustrated in FIG. 1A, the substantially interchangeable and parallel lower and upper storm panel attachment units 10 are secured to the structure 38 with appropriate fasteners 18, to facilitate the installation of protective storm panels 44.

The method of fabrication of this embodiment is as follows. The panel attachment unit 10 includes a PVC pipe tracking element 20 and a PVC pipe attachment element 14 which are formed from standard schedule 40 PVC (polyvinyl chloride) pipe. This low cost, non-corrosive PVC pipe is of the type widely available for domestic and commercial use and would be readily selectable by a person of ordinary skill in the art. FIG. 1B shows an end view of the panel attachment units 10 mounted above and below a window opening 42. As illustrated, the tracking element 20 is a larger pipe size than the attachment element 14. The preferred schedule 40 PVC pipe sizes for window openings 42 up to six feet wide (across the bottom) would be 1½ inch PVC pipe for the tracking element 20 and 1½ inch PVC pipe for the attachment element 14. Panel attachment units 10 to protect window openings 42 wider than six feet might call for larger PVC pipe sizes.

In this embodiment, as shown in FIG. 1A, the tracking element 20 is longer than the attachment element 14. The minimum preferred length of the tracking element 20 must first be determined. It is recommended to fabricate the tracking element 20 a minimum of six inches longer than the width of the window opening 42 to be covered. The minimum preferred length of the tracking element 20 will include the width of the window opening 42, a preferred one inch storm panel 44 overlap at each side of the window opening 42 and two inches at each end of the tracking element 20 for accommodating a method of discouraging the removal of the storm panel by looters, to be discussed later in the specification. Now turning to the attachment element 14, in this embodiment, the preferred length of the attachment element 14 would be four inches shorter than the tracking element 20 in order to accommodate a method of discouraging looters covered later. It is obvious that panel attachment units 10 could be fabricated in virtually an unlimited number of lengths, dependent upon the width of the window opening 42 to be covered.

FIG. 2A shows a perspective view of the tracking element 20 after a section has been removed creating a panel channel track 22 the full length of the PVC pipe tracking element 20 with retaining faces 26, an inside surface 24 and a panel channel track 22 with a preferred minimum width of ⅞ inch. As shown in FIGS. 2A, 2B, and 2C, a security fastener aperture 70 is drilled through the center of the tracking element 20 at a point equally distant from each end of the tracking element 20. The preferred hole size for the security fastener aperture 70 is ⅜ inch. FIG. 2B shows a top view of the tracking element 20 illustrating the retaining faces 26 and two security device apertures 28 drilled through the inside surface 24 of the tracking element 20 at each end of the panel tracking element 20. The preferred location of the security device apertures 28 is one inch from each end of the tracking element 20 on the inside surface 24 of the tracking element 20 and opposite the panel channel track 22. The preferred hole size for the security device apertures 28 is ⅜ inch.

FIG. 3 is a perspective view of the attachment element 14 before the bonding, welding, and drilling processes to be described next.

FIGS. 4A (perspective view), 4B (front view), and 4C (end view) illustrate a panel attachment unit 10 after the PVC tracking element 20 and the PVC attachment element 14 have been chemically welded together, creating a bonded area 34. All PVC materials have characteristics permitting a fusion of materials together upon application of many commercially available PVC liquid fusion compounds. These bonding compounds are formulated to ensure the fusion between PVC plastic materials and are proven formulations combining specific ingredients formulated to achieve the desired bonding result. Such PVC pipe bonding compounds are available in the hardware and big box retail plumbing departments and are readily selectable by a person of ordinary skill in the art. Heat gun plastic welding is an alternative bonding option. Sources for equipment and materials for heat guns and plastic welding rods include, but are not limited to, Plastic Welding Technologies, Auto Body Toolmart, and Pamran Company. The methods of heat gun welding are well known in the art. The known and proven bonding and welding procedures discussed, known by a person of ordinary skill in the art, will form a single integrated unit after the parts have been welded together.

Referring now to FIG. 4C, the bonding of the PVC pipe attachment element 14 to the tracking element 20 will be described. As illustrated In FIG. 4C, during the described welding process, the PVC pipe attachment element 14 and the tracking element 20 are positioned against each other, while positioned against a simulated vertical building structure designated as a vertical reference plane 36 to ensure that the panel channel track 22 and the retaining faces 26 of the tracking element 20 are aligned parallel with the surface of the vertical reference plane 36. FIG. 4C shows the bonded area 34 following the welding process. Adhesive caulk 32 is then applied to both sides of the bonded area 34 to form an approximate one-quarter of an inch bead of adhesive caulk 32 for increased strength and cosmetic appearance enhancement. Adhesive latex acrylic caulks 32 are available in multiple formulas, colors and brands. Desired characteristics of the adhesive latex acrylic caulk 32 would include paintable, exterior grade, and mildew resistant.

It is recommended that a plurality of attachment element apertures 16 be drilled in the attachment element 14 following the welding process. As shown in FIG. 1A, the PVC pipe attachment element 14 includes apertures 16 adapted for receiving fasteners 18 for attaching the panel attachment units 10 to a building structure 38. As illustrated in FIG. 4C, following the welding process, the PVC pipe attachment element apertures 16 can then be drilled through the center of the attachment element 14 accurately at right angles to and perpendicular to the vertical reference plane 36. The preferred hole size for the attachment element apertures 16 is ⅜ inch. The number and spacing of the holes 16 can vary within the scope of the present invention. FIG. 4A shows a perspective view of the tracking element 20 and the attachment element 14 following the welding process illustrating drilled attachment element 14 fastener apertures 16 and the drilled security fastener aperture 70.

Figure 5A:
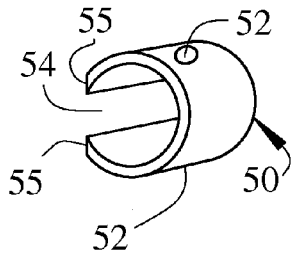
Figure 5B:
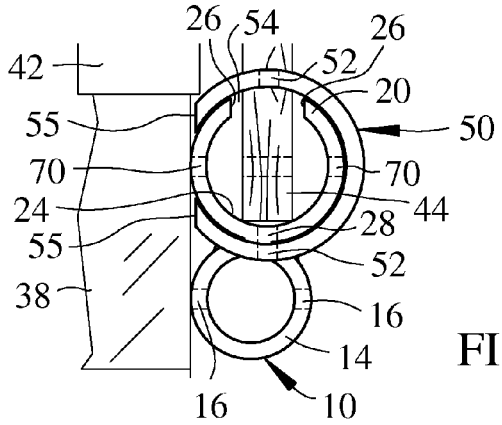
Figure 5C:
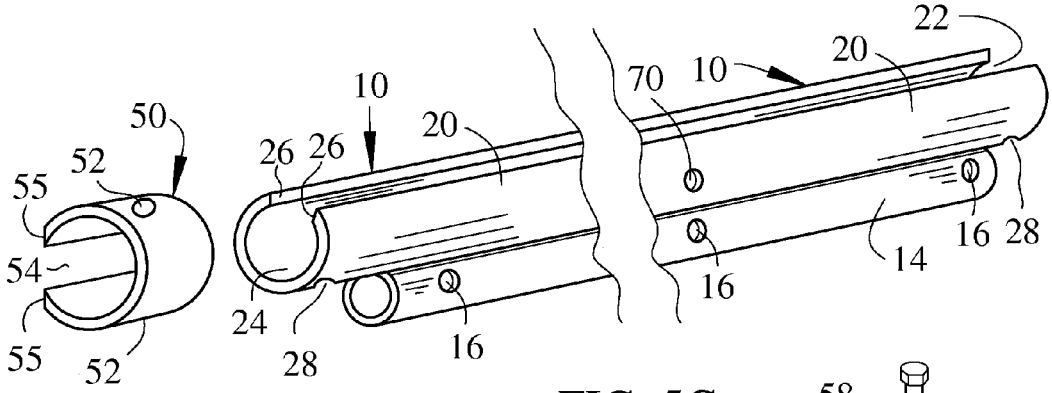

The preferred material for fabrication of a security sleeve 50, as shown in FIG. 5A, is a standard PVC NS (no stop) pipe coupler, available to fit standard PVC pipe sizes, said coupler being well known to a person of ordinary skill in the art. FIGS. 5A, 5B, and 5C illustrate a security sleeve 50, cut to a preferred length of two inches, following fabrication from a PVC NS pipe coupler matching the PVC pipe size of the tracking element 20, ensuring the security sleeve 50 to be of a proper size to slide horizontally over the end of the tracking element 20. As illustrated in FIGS. 5A (perspective) and 5B (end view), the security sleeve 50 is shown with two security sleeve apertures 52 drilled and centered approximately one inch from the end of the security sleeve 50. FIGS. 5A and 5B illustrate the security sleeve 50 after a section has been removed creating an opening 54 the full length of the security sleeve 50 and two security sleeve faces 55. As shown in FIG. 5B, the security sleeve 50 is now adapted to slide over the end of the tracking element 20 of an installed panel attachment unit 10 secured to a building structure 38 with security sleeve faces 55 flush with the building structure 38.

An alternative and simplified embodiment of panel attachment units 10 will now be described. This embodiment is substantially similar to that the first embodiment absent the described provisions for the installation of security sleeves 50. In lieu of the panel attachment unit 10 being fabricated with track channel 20 and the attachment element 14 being of different lengths as shown in FIG. 1A as a provision for installing security sleeves, the tracking element 20 and the attachment element 14 can be fabricated to be of equal lengths, as illustrated in FIG. 7. This embodiment, as shown in FIG. 7, illustrates the panel attachment units 10 with tracking elements 20 and attachment elements 14 fabricated to be of equal lengths and flush at each end of the panel channel attachment unit 10. The preferred minimum length of this embodiment of the panel attachment unit 10 would be two inches wider than the window opening 42 to be protected. As shown in FIG. 7, the tracking element 20 and the attachment element 14 are fabricated and chemically welded together, as described earlier, to form the illustrated panel attachment units 10. The fabrication of this embodiment would imitate and include the same steps as the first embodiment, with the elimination of the security sleeves 50 and the steps related to providing for the installation of security sleeves 50.

Operation

The manner of installing and using the panel the attachment units 10 and building owner selected storm panels 44 will be described. The panel attachment units 10 operate and function in a manner superior to the prior art in the ability to accept, support, and retain a wide variety of usable and available storm panel materials. As shown in FIGS. 1A and 1B, the lower installed panel attachment unit 10 supports the weight of the panel 44 on the inside surface of the track channel 24 between the retaining faces 26. The upper panel attachment unit 10 serves to retain the installed storm panel 44 between the retaining faces 26 of the upper panel attachment unit 10.

As shown in FIGS. 1A and 1B, a storm panel attachment unit 10 is attached to the structure 38 below the base of the window opening 42, with a plurality of appropriate fasteners 18 through the fastener apertures 16 provided in the attachment element 14. The lower panel attachment unit 10 is installed with the panel channel track 22 upwardly opening, to serve as the storm panel 44 support and retaining unit. A similar panel attachment unit 10 is attached to the structure 38 above the window opening 42 directly above and parallel to the lower panel attachment unit 10 with a plurality of appropriate fasteners 18 passing through fastener apertures 16 of the upper panel attachment unit 10. As shown in FIGS. 1A and 1B, the upper panel attachment unit 10 is attached with the panel channel track 22 downwardly opening to provide a track and retaining channel for receiving one or more storm panels 44.

Appropriate fasteners to install the panel attachment units 10 to a wooden building structure 38 could be standard hex headed lag bolts. Installation to a masonry building structure 38 could be standard cement screw anchors. The selected appropriate fasteners are recommend to be of galvanized plated metal or of stainless steel material, to minimize the corrosive effects of the salt air environments encountered along coastal regions. It will be understood that a variety of fasteners could be used without departing from the spirit and scope of the present invention.

The building owner users of this invention, a panel attachment system, can select and fashion rigid rectangular protective panels 44 from a wide variety of panel materials which are sized to cover their window openings 42. Panel material selection taking place during non-emergency situations might include but not be limited to plywood, plastic, polycarbonate, fiberglass, corrugated plastic, corrugated steel sheets, pleated steel sheets, or other structurally sound and protective materials. Plastic panels are growing in popularity including lexan (trademark), tuffak (trademark), polycarbonate, fiberglass, and corrugated plastic. In emergency cases, such as following a severe storm watch or warning, the most common panel material in demand is exterior grade plywood, pressure treated plywood, and waterproofed OSB or wood sheathing. During such situations of an impending severe storm, plywood supplies are quickly exhausted at local and big box lumber yards. The panel attachment units 10 described are not limited to providing a means for attaching a specific type of panel material to a building structure. The present invention is compatible with a wide variety of panel material solutions from whatever panel material, common lumber, or combinations of materials are available immediately prior to the arrival of a severe storm.

Once selected, the storm panel material 44 must be sized. Proper sizing would include a rectangular storm panel 44 arrangement, covering and protecting the window opening 42. It is recommended that the width of the storm panel 44 not be wider than the attachment element 14 and be sized to a proper height to slide horizontally between the upper and lower attachment and tracking units 20 of the upper and lower panel channel tracks 22 of the storm panel attachment units 10. As illustrated in FIG. 1B, the vertical height of the panel 44 should allow for a preferred minimum clearance of ½ inch between the inside surface 24 of the upper panel channel track 22 and the top edge 46 of storm panel 44. Said clearance will facilitate the bottom edge 45 of storm panel 44 sliding horizontally along the inside surface 24 of the lower attachment unit 10, held between the retaining faces 26 of the upper and lower attachment units 10. It is recommended that the installed panel 44 be centered over the attachment element 14 of the lower panel attachment unit 10 to facilitate the installation of security sleeves 50 at each end of the lower tracking element 20.

Figure 5D:
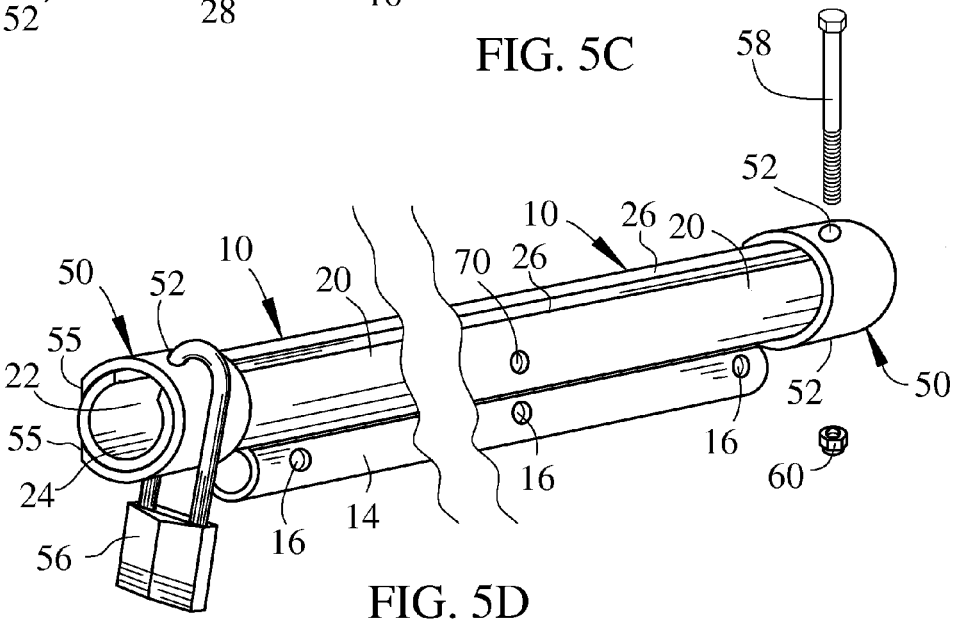

Turning now to FIGS. 5C and 5D, a method of discouraging the removal of the storm panel 44 by looters or vandals is illustrated. A security sleeve 50 is adapted to slide over the end of the lower tracking unit 20 of an installed panel attachment unit 10 secured to a building structure 38 with security sleeve faces 55 flush with the building structure 38, as illustrated in FIG. 5B. Security apertures 52 allow the building owner the option of installing a padlock security device 56 or cap screw 58 with locknut 60, at opposite ends of the lower tracking element 20. The padlock security device 56 or cap screw 58 with locknut 60 would pass through the security sleeve aperture 52 and the tracking element security device aperture 28 as a means to discourage the unauthorized removal of the installed storm panel 44.

As shown in FIG. 6, the design of the panel attachment system allows a plurality of attachment units 10 to be installed in an end-to-end fashion in order to form a contiguous arrangement of storm panel attachment units 10 in certain applications requiring storm protection for long or extended window openings 42.

In lieu of security sleeves 50, an optional supplemental method of securing the storm panel 44 to the structure 38 and the lower attachment unit 10 is available. Provisions are made in panel attachment units 10 for the installation of a optional security fastener 72. As shown in FIGS. 1A, 1B, and FIG. 7, the security fastener 72 is installed through the security aperture 70 of the lower attachment unit 10 and the installed panel 44 into the building structure 38 so as to anchor the attachment unit 10, panel 44, and the building structure 38 securely together.

In lieu of the lower panel attachment unit 10 being attached to a vertical building structure 38, an alternative preferred embodiment, as shown in FIGS. 8A and 8B, illustrates the lower panel attachment unit, here designated as 12, fabricated to receive fasteners to attach to and be supported by a horizontal surface, such as an outside deck, porch floor, or concrete slab. The fabrication of this embodiment would imitate and include the same steps as the first embodiment except that during the described welding process the PVC pipe attachment element 14 is welded in a different position to function as a deck attachment element, here designated as 15. As shown in FIG. 8B, the deck attachment element 15 and the tracking element 20 are positioned against each other while positioned on top of a simulated horizontal building structure designated as 41. Otherwise, this embodiment is the same as that of FIGS. 1A and 1B.

Alternative Embodiments

An additional embodiment is shown in FIGS. 9A and 9B illustrating the storm panel attachment unit 10 fabricated with a standard rectangular plastic tubing track element 66 and a solid rectangular rod attachment element 68. The rectangular plastic tubing track element 66 combines the attributes of the first embodiment including the panel channel track 22, retaining faces 26, and the inside tracking surface 24. The solid rectangular rod attachment element 68 includes fastener apertures 16 for attachment to a building surface 38.

An additional embodiment is shown in FIGS. 9C and 9D illustrating the storm panel attachment unit 10 fabricated from standard rectangular plastic tubing track element 66 with a hollow rectangular attachment element 69. The rectangular plastic tubing track element 66 combines the attributes of the first embodiment including the panel channel track 22, retaining faces 26, and the inside tracking surface 24. The hollow rectangular attachment element 69 includes fastener apertures 16 for attachment to a building surface 38.

An additional embodiment is shown in FIGS. 10A and 10B illustrating the storm panel attachment unit 10 as a one-piece plastic extrusion or molding. This alternative plastic embodiment combines the attributes of the first embodiment including the panel channel track 22, retaining faces 26, the inside tracking surface 24, fastener apertures 16 for attachment to a building structure 38 and the security fastener aperture 70.

An additional embodiment is shown in FIG. 11 illustrating the storm panel attachment unit 10 in a non-emergency application. In lieu of storm panel 44 material, a holiday decorator panel 48 is fabricated and sized to slide horizontally between the upper and lower attachment and tracking units 20.

As in all described embodiments, the plastic composition of each fabrication is a non-corrosive, non-rusting rigid plastic material achieving the same advantageous effects in each embodiment.

Advantages

Accordingly, one or more embodiments of the present invention may have one or more of the following advantages:

(a) to provide an affordable and improved solution for the rapid installation of emergency storm panels by the average home or business owner prior to or following a storm watch or warning, (b) to provide a panel attachment system designed to reduce manufacturing requirements and costs for set-up, tooling, and jigs, (c) to provide an effective storm panel attachment system fabricated from materials selected for their non-rusting and non-corrosive properties to reduce the corrosive affect of salt air coastal environments, (d) to design a system fabricated from relatively low-cost materials in plentiful supply to enhance affordability, (e) to provide an off-the-shelf panel attachment system designed to reduce installation requirements and eliminate extended delivery and custom fabrication lead times or costly custom designing, (f) to provide a panel installation system without a requirement for indented walls or inside sills around window openings, (g) to provide a system with a provision allowing an owner the option of securing or locking installed storm panels in order to discourage unauthorized removal of panels and storm related looting and vandalism, (h) to provide a panel installation system designed to reduce tooling and manufacturing set-up costs when fabricating a variety of lengths and sizes, (i) to provide a system of compatible components allowing side by side installation for protecting long expanses of windows, (j) to provide a system which reduces the need to discard storm panels damaged by nailing and bolting them directly to the outside building surface, Further advantages of my interchangeable design of the assemblies allows panel installation from the right or left side of the opening, Therefore, there is a need in the marketplace for an affordable and relatively simple storm panel installation system, installed by the owner following a storm watch or warning, effective in protecting windows and doors from wind and flying debris during a severe storm, The improved panel installation system herein invented can, in one configuration, fill the above need using an unobvious application of corrosion-resistant, off-the-shelf Polyvinyl Chloride (PVC) pipe, Further advantages of my invention will become apparent from a consideration of the drawings and ensuing description.

CONCLUSION, RAMIFICATIONS, AND SCOPE

Accordingly, the invention provides the home or business owner, with average do-it-yourself skills, a means of installing a low cost system for attaching and retaining storm panels following a severe storm warning, immediately prior to the arrival of the storm, as an acceptable means of protecting windows and doors from wind damage, wind driven debris, and heavy rain. In hurricane and storm prone areas, certain building codes are now in place, requiring new home builders to provide panels to the home owner as protection for window openings. In some areas, storm panels are provided while lacking a means for installation over the window openings. The invention design allows retrofitting existing homes and businesses built of wood or masonry with a practical form of protection.

Accordingly, the reader will see that the panel attachment units require minimum manufacturing facilities. The recommended material for the invention is PVC (polyvinyl chloride) pipe or a PVC extruded fabrication offering improved strength to weight ratios over other materials thereby increasing safety and convenience. PVC material is readily available, relatively low cost, a non-conductor of electricity, corrosion resistant, chemical resistant and immune to electrochemical reactions caused by acids, bases, and salts that cause corrosion in metals. PVC production is an energy efficient manufacturing process in addition, with more than half of the raw material used in PVC production provided by salt, of which there is a virtually unlimited supply.

With respect to the above description then, it is to be realized that the optimum dimensional relationships for the parts of the invention, to include variations in size, materials, shape, form, function, and manner of operation, unit, and use, are deemed to be within the expertise of those skilled in the art, and all equivalent structural variations and relationships to those illustrated in the drawings and described in the specification are intended to be encompassed by the present invention.

Although only a few embodiments of the present invention have been described in detail hereinbefore, all improvements and modifications to this invention within the scope or equivalents of the claims are covered by this invention.

What is claimed is:

1. A system for attaching one or more rigid rectangular storm panels on a building to cover a building opening in said building during severe weather, the system comprising:

(a) at least two interchangeable, substantially identical plastic attachment and retaining units, (b) each of said plastic attachment and retaining units fabricated of rigid, non-corrosive, non-rusting, non-oxidizing extruded plastic materials, said attachment and retaining units comprising a combination of one attachment element and one receiving and retaining element attached together, forming one said attachment and retaining unit, (c) said attachment element with attaching means for affixing said attachment unit to a substantially vertical building surface, (d) said receiving and retaining element being fabricated of hollow extruded plastic, open at both ends, with a predetermined cutout of a generally C shaped cross section, resulting in a storm panel passageway from end to end, said passageway sized to accept a plurality of storm panel materials selected from the group consisting of CDX plywood sheathing, corrugated plastic panels, honeycombed plastic panels, treated decking materials, OSB board panels, finished lumber boards, and fence pickets, said storm panel materials having a front panel surface, a back panel surface, a bottom panel surface and a top panel surface, (e) at least one of said attachment and retaining units mounted above said building opening in said building, the receiving and retaining element downwardly oriented adjacent to the top of said building opening in said building, (f) at least one of said attachment and retaining units mounted below said building opening, said receiving and retaining element upwardly oriented adjacent to the bottom of said building opening, parallel to and cooperating with the upper said attachment and retaining unit as a means for slidably accepting, supporting and captivating said storm panel materials in a substantially vertical orientation parallel to said building opening, (g) said C shaped cross section of said receiving and retaining element with said storm panel passageway provides adjacent sidewalls within said storm panel passageway, said sidewalls defining cavities between said front panel surface and said sidewall and said back panel surface and said sidewall, said cavities providing space to receive accumulated debris in said storm panel passageway during the sliding action of installing said storm panel materials, whereby said debris is contained in said cavities, (h) a means for removably securing said storm panel materials between the above mounted attachment and retaining unit and the below mounted attachment and retaining unit, whereby said system for attaching storm panels is capable of being installed in a time frame that is less than 2 days after a hurricane storm warning is issued.

2. The attachment system as recited in claim 1, wherein:

the attachment and retaining units mounted above said building opening and the attachment and retaining units mounted below said building opening are positioned end-to-end in multiple series as a means to accept said storm panel materials as protection for said building openings of extended length.

3. The attachment system as recited in claim 1, wherein:

the means for attachment comprises a plurality of apertures sized to accept a plurality of fasteners selected from the group consisting of galvanized hex lag bolts, stainless steel fasteners, and various concrete anchors for affixing the attachment and retaining units to the vertical building structure.

4. The attachment system as recited in claim 1, wherein:

said receiving and retaining element and said attachment element are each fabricated of predetermined sizes of schedule 40 PVC (polyvinyl chloride) plastic pipe, these elements are chemically welded together to form one plastic attachment and retaining unit.

5. The attachment system as recited in claim 1, wherein:

said attachment and retaining unit is formed as a single extruded plastic profile unit, extruded in such a way as to include an attachment portion, and a receiving and retaining portion, said attachment portion configured to be substantially a rigid plastic element with means for attachment to said building, said receiving and retaining portion configured to include a C shaped elongated supporting and retaining channel element, said channel sized to accept a plurality of storm panel materials selected from the group consisting of CDX plywood sheathing, corrugated plastic panels, honeycombed plastic panels, treated decking materials, OSB board panels, finished lumber boards, and fence pickets.

6. The attachment system as recited in claim 1, wherein:

(a) at least one of said attachment and retaining units mounted above said building opening in said building, the receiving and retaining element downwardly oriented adjacent to the top of said building opening in said building, (b) at least one of said attachment and retaining units mounted below said building opening with attaching means for affixing said attachment and retaining unit to a substantially horizontal building surface such as a cement deck, a wooden floor, a window sill, or outside decking material, the receiving and retaining element upwardly oriented adjacent to the bottom of said building opening, parallel to and cooperating with the upper said attachment unit as a means for slidably accepting, supporting and captivating said storm panel materials in a substantially vertical orientation parallel to said building opening.

7. The attachment system as recited in claim 1, wherein:

said receiving and retaining element is sized of a predetermined length, sufficiently longer than said attachment element and adapted to accept security sleeves of a predetermined length, said security sleeves installed slidably over each end of the receiving and retaining element with means to accept anti-theft devices including padlocks or capscrews with cooperating lock nuts as a means to discourage unauthorized removal of said storm panel materials.

8. The attachment system as recited in claim 1, wherein:

said receiving and retaining element is adapted with means to accept and retain decorative holiday window panels and lighted holiday displays.

* * * * *